US005111962A

United States Patent [19]

Oden

[11] Patent Number: 5,111,962

[45] Date of Patent: May 12, 1992

[54] VENDING APPARATUS WITH INTELLIGENT DISPENSATION CONTROL

[75] Inventor: Kenneth W. Oden, Charles Town, W. Va.

[73] Assignee: Royal Vendors, Inc., Kearneysville, W. Va.

[21] Appl. No.: 406,518

[22] Filed: Aug. 21, 1989

[51] Int. Cl.[5] ..... G07F 11/00

[52] U.S. Cl. ..... 221/1; 221/13; 221/15; 221/129

[58] Field of Search ..... 221/129, 124, 123, 195, 221/194, 191, 13, 15, 1, 3

[56] References Cited

U.S. PATENT DOCUMENTS 3,352,454 11/1967 Craven .
3,795,343 3/1974 Shigemori et al. .
4,044,877 8/1977 Burton .
4,359,147 11/1982 Levasseur .
4,705,176 11/1987 Oden .
4,706,842 11/1987 Guadagnino .

*Primary Examiner*—David H. Bollinger
*Attorney, Agent, or Firm*—Mason, Fenwick & Lawrence

[57] ABSTRACT

A vending apparatus ensures that the delay between a customer's selection of an article, and the dispensation of the selected article, is minimized, preferably to less than a predetermined delay, regardless of the point in a multi-article vending cycle. The reduced selection-dispensation delay is achieved through use of a "memory and learning" feature. The "memory and learning" feature is predicated on a recall and/or analysis of the relative times of occurrence of one or more previous dispensations, so that the apparatus' present position in the multi-article vending cycle is determined. The "memory and learning" feature allows the vending apparatus to anticipate how long the article dispensation mechanism should run after the present dispensation, to strategically poise the mechanism for a subsequent dispensation having an optimum selection-dispensation delay. Also disclosed are systems and methods for ensuring that articles are dispensed at a proper temperature, even after a "sold-out" condition is corrected; and for sounding an alarm if a person jars the vending apparatus in an attempt to improperly jar an article from the vending apparatus.

6 Claims, 8 Drawing Sheets

VENDING APPARATUS WITH INTELLIGENT DISPENSATION CONTROL

BACKGROUND OF THE INVENTION

1. Field of the Invention

The present invention relates to vending apparatus. More specifically, the invention relates to vending apparatus in which dispensing of articles is intelligently controlled.

2. Related Art

Vending apparatus are known in the art. Generally, vending apparatus involve columns for storing products which may be selected by a customer for dispensation, usually after insertion of a given amount of "credit" in the form of coins or bills. These vending apparatus generally have mechanisms or circuitry designed to supplement the dispensation function.

For example, U.S. Pat. No. 4,044,877 (Burton) discloses a malfunction lock-out circuit which allows isolation of a malfunctioning section of the vending apparatus. The isolation of a malfunctioning section of the vending apparatus allows articles in other columns in the vending apparatus to continue to be dispensed. As in many known vending apparatus, the control circuitry involves cams.

U.S. Pat. No. 4,359,147 (Levasseur) discloses an apparatus for controlling vending functions involving vend/pay-out control logic governed by a time period in which a product vend may be sensed. The vend/pay-out control logic may involve the use of a microprocessor, especially for use in the decision-making functions.

These patents are incorporated by reference as if reproduced in full below.

Known vending apparatus possess the limitation that, under certain circumstances, there is an undesirably long time delay between the time a selection is made by a customer and the time the product is delivered to him. In the field of vending machines, the perception of customers is very important. Therefore, any feature which a customer might consider to be undesirable, such as an unnecessary delay in the dispensation of an item, should be modified. Therefore, in the field of vending apparatus, it is desirable to provide a vending apparatus in which the time delay between a customer selection and the article dispensation is minimized.

In known systems, the delay between customer selection and article dispensation varies considerably, depending on which point in a multi-article vending cycle the dispensing mechanism is in, for a given column. More specifically, as can be seen in FIG. 4, arm 402, with first and second rods 404 and 406, rotate about an axis which runs through motor 206 and a center rod 408. A "quick-vend" cycle occurs when arm 402 rotates so as to allow first rod 404 to move downward, which allows first article 308 to fall down, no longer restrained by higher edge 304 of separator panel 302. Soon thereafter, a relatively small rotation of the motor 206 and first rod 404 allows second article 310 to fall down, no longer restrained by lower edge 306 of separator panel 302. The relatively small "quick-vend" cycle described immediately above, is in contrast to the comparatively long time duration between dispensation of second article 310 and third article 312. This longer time duration derives from the fact that, in known systems, arm 402 must traverse a greater angular path between dispensation of articles 310 and 312, then it did between articles 308 and 310.

Therefore, there is a need for a vending apparatus in which the time delay between an article's selection and its dispensation to the customer is reduced, regardless of the point in the dispensation cycle.

It is known in the art that, after a "sold-out" condition has been encountered for a particular column, there is a problem as to how to ensure that the articles which are distributed after the column has been refilled are of the proper temperature. When the articles are soda cans, it is desirable to have the soda cans be cooled to within a certain temperature range before they are dispensed. In known systems the problem has been solved by refusing to dispense the last two articles in a column, instead prematurely indicating a "sold-out" condition in that column. In this manner, after the column is reloaded with new articles, at least the first two articles will allegedly be at the desired temperature.

This known solution has several drawbacks. First, the immediate sale of the last two (or similar number) items is sacrificed, causing cumulative loss of revenue which may be substantial. Also, when new articles are loaded atop the two "old" articles (which are already at the desired temperature), the physical contact of the "old" articles with the new articles causes heat transfer to occur. This heat transfer diminishes the effectiveness of the method in providing articles which are the proper temperature.

Therefore, there is a need to provide a vending apparatus in which some characteristic of the articles, such as temperature, be controlled so that no articles need be vended until they are of the proper temperature, even after the vending apparatus has been reloaded.

It is also known that certain vending machines have the defect that a forward-to-backward rocking motion may allow an item to be released from a column improperly (one example of this potential danger is shown in the apparatus of FIG. 4, in which, after article 308 has been dispensed, a forward rocking motion of the motion may cause article 310 to fall forward, and be dispensed under higher edge 304). This manner of dispensation not only constitutes theft, but causes a "dry-vend" in which the next subsequent customer in many known systems receives no product, resulting in a loss of good will toward the vending apparatus manufacturer, and perhaps also to the article manufacturer.

Therefore, there is a need to provide a vending apparatus in which improper removal of articles is inhibited or deterred.

SUMMARY OF THE INVENTION

It is a first object of the present invention to provide a vending apparatus, and a controller therefor, which allows reliably fast dispensation of articles.

It is a further object of the present invention to reduce the mechanical complexity, reduce the quantity of components such as switches, and reduce the quantity of wiring (especially 110-volt wiring) in vending apparatus.

It is a further object of the present invention to render unnecessary the presence of cams for timing in vending apparatus.

It is a further object of the present invention to increase the reliability of vending apparatus.

It is a further object of the present invention to allow dispensation of products of a plurality of sizes in the same column of a vending apparatus, without modifying the column or mechanism for dispensing the product.

It is a further object of the present invention to provide a vending apparatus in which all articles in a given column are capable of being vended, without subsequent dispensation of newly-loaded products which have not been cooled or heated to the proper temperature.

It is a further object of the present invention to provide a system and method which insures that, after a "sold-out" condition is encountered and corrected, articles are not dispensed until they have reached a desired temperature range.

It is a further object of the present invention to facilitate multi-pricing, so that products in different columns may easily, quickly and reliably be assigned different prices.

It is a further object of the present invention to provide a vending apparatus in which the articles are protected from improper dispensation, such as through theft by jarring or tipping the vending apparatus.

Thus, the present invention provides a vending apparatus, and an intelligent dispensation controller therefor, in which the duration of the time delay between a customer's article selection and the dispensation of that article is minimized, preferably to less than a predetermined time duration. The present invention involves a "memory and learning" feature which determines where the vending mechanism for a particular column should stop, in anticipation of a subsequent vend. A motor is caused to run a proper length of time after the dispensation of a first article, so that the amount of time required to dispense a subsequent article is minimized.

The invention also provides a system for ensuring that, after correction of a previously detected "sold-out" condition, articles in a vending apparatus are brought to within a proper dispensation temperature range before dispensation, comprising an article selection device for receiving a customer selection, and generating an article selection signal; a dispensation mechanism for dispensing an article in response to the article selection signal; means for detecting a "sold-out" condition in the vending apparatus; means for sensing a reloading of articles into the vending apparatus, so that the "sold-out" condition is corrected; means for defining a time period after the "sold-out" condition is corrected; means for controlling the temperature of the articles; and means for inhibiting the dispensation mechanism from dispensing the article, even in the presence of an article selection signal, during the time period after the "sold-out" condition was corrected, so as to allow the means for controlling temperature of the articles sufficient time to bring the articles to within the proper dispensation temperature range.

The invention further provides a device for reducing incidents of improper removal of articles from a vending apparatus, the device comprising a sensor for detecting when the orientation of the vending apparatus is different than a normal orientation, and producing a signal; and an alarm device, responsive to the signal from the sensor, for sounding an alarm to indicate the occurrence of an improper orientation of the vending apparatus.

The invention also provides an automated method of vending articles to a customer, comprising receiving an article selection, and generating an article selection signal in response thereto; activating a dispensation mechanism in response to the article selection signal to dispense a selected article; sensing the dispensation of the selected article, and generating an article dispensation signal in response to the sensing; measuring the times of occurrence of one or more recent sensings of the article dispensation signal; and deactivating the dispensation mechanism after a period of time, in accordance with the measured times of occurrence of the one or more recent sensings, so as to reduce a time delay between a subsequent article selection and the dispensation of that subsequent article to within an optimum delay range.

BRIEF DESCRIPTION OF THE DRAWINGS

The invention is more easily understood if the Detailed Description is read in conjunction with the accompanying drawings, in which like reference numerals refer to like elements throughout, and in which.

DETAILED DESCRIPTION OF THE PREFERRED EMBODIMENTS

In describing preferred embodiments of the invention, specific terminology will be employed, for the sake of clarity in presenting those embodiments to those skilled in the art. However, the invention is not to be limited to the specific terms so selected, and it is understood that each specific term includes all technical equivalents which operate in a similar manner to accomplish a similar purpose.

Figure 1:
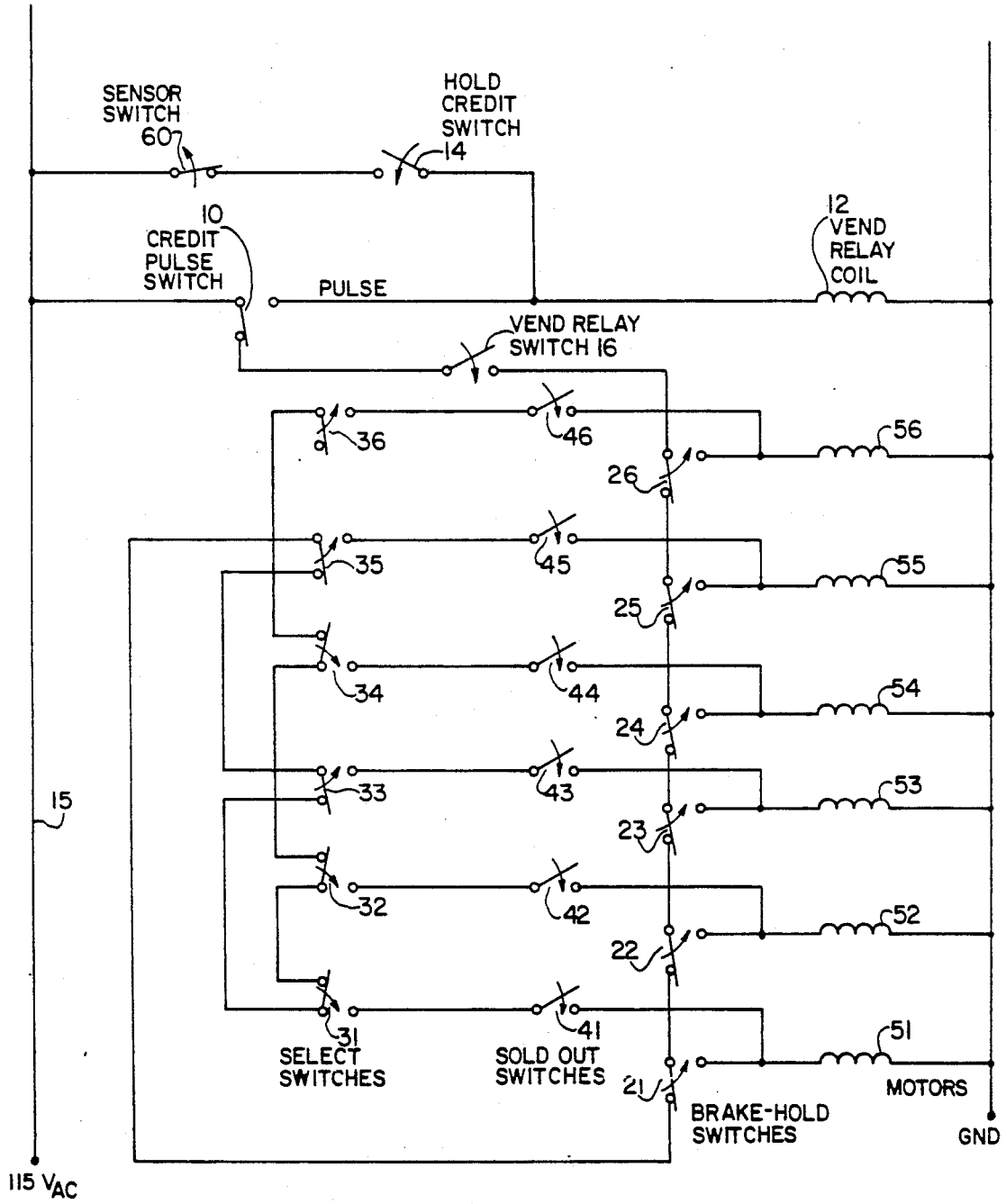
FIG. 1 is a diagram illustrating a mechanically-implemented embodiment of the present invention.

FIG. 1 illustrates a mechanical implementation of the present invention. A second embodiment, that illustrated in FIG. 2, involves the use of an electronic controller board. Using either or both implementations of the teachings of the present invention, certain or all of the advantages described herein may be obtained. Considerations of cost, reliability, environmental factors, and so forth may enter into a decision as to which of the two embodiments is preferred for a given application.

FIG. 1 shows schematically the components of a preferred mechanical implementation. The implementation involves circuitry disposed between a 115 V (AC) source 15 and a ground conductor 16. The circuit comprises switches which are illustrated schematically. The schematic illustration of the switches demonstrates their function, and not necessarily their particular implementation. For instance, switch 14 is illustrated as a normally open switch with an arrow pointing in the direction of the closure to indicate that, when activated, it becomes closed. In contrast, a switch such as brake-hold switch 26 is normally in a first position (extending toward switch 25) but, when activated, breaks the connection to switch 25 and closes the connection to motor 56, as indicated by an arrow. Also, some switches are tripped by application of current while others remain stable even when a current is applied, so that a full understanding of the illustrated embodiment should be gained through a reading of the following text.

It is understood that the "center" terminal of a switch may contact either a "second" terminal, or, alternatively, a "third" terminal. This is a functional and not necessarily a structural, description. That is, the switching functions described herein may be achieved by structures other than those specifically disclosed.

The implementation of the switches as illustrated may vary. For example, in the preferred embodiment, the brake-hold switches may actually be two switches which always assume a state opposite to the other. Specifically, switches such as Model No. V7, from MICRO SWITCH, of Freeport, Ill., are advantageously employed.

The structure of the mechanical implementation (FIG. 1) is as follows.

A credit pulse switch 10 has its center terminal tied to the 115 V line 15. The output of this credit pulse switch 10, a momentary switch, is tied to both a vend relay coil 12 and a normally open hold credit switch 14. The opposite end of the vend relay coil 12 is tied to ground 16. The opposite end of the hold credit switch 14 is tied to a normally closed sensor switch 60. Normally closed sensor switch 60 has its opposite end connected to the 115 V line. Sensor switch 60 may be a vibration-type sensor switch which breaks a connection temporarily, after being jarred, as in many automobile anti-theft devices.

The second terminal of credit pulse switch 10, normally connected to the center terminal of the credit pulse switch at 115 V, is connected to normally open vend relay switch 16. The other end of end relay switch 16 is connected to the center terminal of a brake-hold switch 26. A second terminal, normally connected to the center terminal, leads to the center terminal of a second brake-hold switch 25. The third terminal of brake-hold switch 26, not normally connected to the center terminal, is connected to a corresponding motor 56. The opposite end of motor 56 is connected to ground.

In a manner similar to brake-hold switch 26 and motor 56, brake-hold switches 21 through 25 are normally connected in-series, but are switchable to be connected to respective motors 51 through 55. The opposite ends of the motors 51 through 55 are all connected to ground.

The second terminal from the last brake-hold switch, here 21, is connected to a center terminal of a second select switch 35. A second terminal of the select switch 35 is normally connected to the center terminal, and is connected to the center terminal of a fourth select switch 33. The second terminal of the fourth select switch 33, normally connected to the center terminal, is connected to the center terminal of a sixth select switch 31. A second terminal, normally connected to the center terminal of switch 31, is connected to the center terminal of a fifth select switch 32. A second terminal of switch 32, normally connected to the center terminal of switch 32, is connected to the center terminal of a third select switch 34. A second terminal of switch 34, normally connected to the center terminal of switch 34, is connected to the center terminal of a first select switch 36.

In this manner, select switches 31 through 36 are normally connected in-series.

Each of select switches 31 through 36 has a third terminal, normally not connected to its center terminal. Each of the third terminals of select switches 31 through 36 is connected to a corresponding sold-out switch, one of 41 through 46. The opposite ends of normally open sold-out switches 41 through 46 ar connected to respective conductors between brake-hold switches 21 through 26 and motors 51 through 56.

The motors 51 through 56 are provided with mechanical-actuated brakes so that there is no drift of the motor, which ensures that only one item is dispensed.

The functioning of the circuit in FIG. 1 will now be presented.

When a sufficient amount of money has been deposited by a customer, momentary credit pulse switch 10 momentarily moves from its normal position to a position which allows a pulse to be issued to vend relay coil 12. The purpose of the vend relay coil 12 is to maintain the credit for as long as both hold credit switch 14 and sensor switch 60 are closed. Also, the pulse from credit pulse switch 10 causes hold credit switch 14, normally open, to close. The closure of hold credit switch 14 is maintained until after dispensation of an article is sensed, in a manner to be described below.

Thereafter, vend relay switch 16, normally open, is closed by virtue of the credit pulse switch 10's receiving the proper credit signal from the coin mechanism. After vend relay switch 16 is closed, power passes through normally series-connected brake-hold switches 21 through 26. Power thus reaches select switches 31 through 36. The apparatus is now ready for receiving a selection from the customer at the select switches.

When a customer selects an article from a given column in the vending apparatus, the position of a corresponding select switch is changed from its normally closed position to a position connecting the switch to one of a corresponding set of sold-out switches 41. The remaining select switches remain in their normally closed position.

When a given select switch, one of 31 through 36, closes, the corresponding sold-out switch, one of 41 through 46 (if closed to indicate a NOT SOLD OUT condition) connects power to the corresponding motor, one of 51 through 56. Activation of one of the motors 51 through 56 causes dispensation of the selected item.

The passage of power through one of the sold-out switches 41 through 46 in turn causes the associated brake-hold switch to change state, preventing their normal (series-connected) state. This interruption of the series-connected state prohibits another selection to be recognized at any of the select switches 31 through 36. Power reaches the activated motor only, via the "short" circuit through vend relay switch 16, and the activated brake-hold switch, one of 21 through 26. Power reaching the motor allows the article dispensation mechanism, which may be one known in the art, to dispense the selected article.

After the motor causes dispensation of an item from a column, a sensor causes a sensor switch 60 to open from its normally closed position. This opened sensor switch 60, which may be a switch such as those used in automobile alarm sensors, causes vend relay coil 12 to lose power, so that hold credit switch 14 returns to its normally open state. This functions as a credit cancellation soon after the article is dispensed. The vend relay switch 16, which had been closed, returns to its normally open state, thereby disabling all motors.

The embodiment shown in FIG. 1 omits certain other circuitry not central to the inventive features described herein. For example, the presence of "sold-out" indicator lamps, and associated activation and deactivation circuitry, is not shown, as such are known in the art. Similarly, particular means of sensing entry of money, determining adequacy of credit for a particular purchase, mechanisms for returning change, mechanisms and indicators for indicating that correct change must be inserted, and so forth, are omitted. However, it is understood that the present invention may be practiced with or without these other mechanisms.

The advantages of the embodiment shown in FIG. 1 include the elimination of a timing cam in control of the article dispensation mechanism. The motor is turned off in response to the sensed dispensation of the article, and not at the end of a given time frame in which an article is expected to have been dispensed. In this embodiment, therefore, the loss of good will of the customer after experiencing "dry vends", failure to receive a selected article due to faulty loading of articles, is minimized; the mechanism may be controlled to keep running until an article is dispensed.

Figure 2:
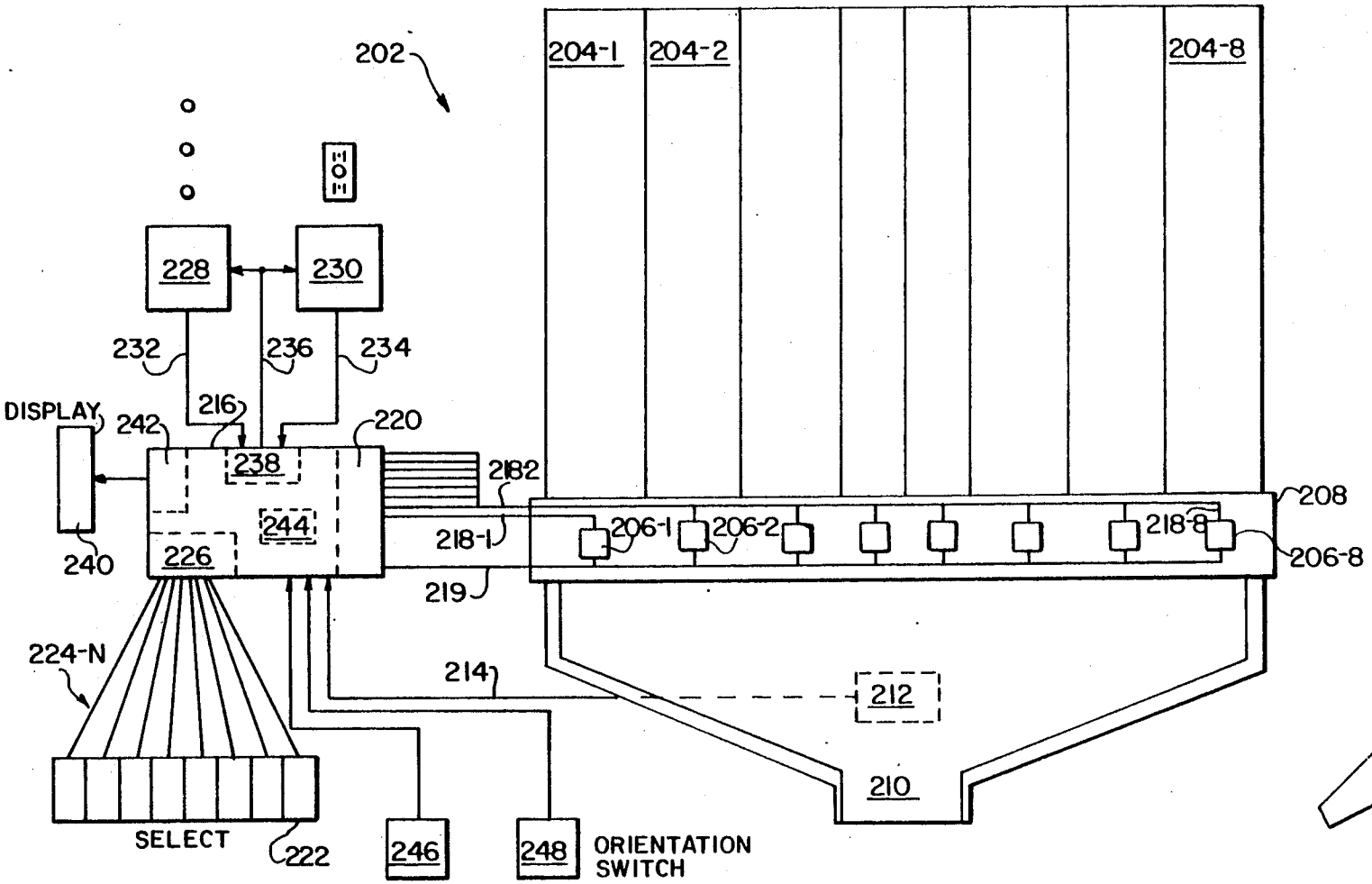
FIG. 2 is a diagram illustrating an embodiment of the present invention in which an electronic controller is employed for governing the timing of article dispensation.

FIG. 2 illustrates a vending apparatus according to a second embodiment of the present invention. FIG. 2 provides a schematic representation of the vending apparatus, simply to aid in the illustration of the features of the preferred embodiments of the present invention. Modifications may be made to the illustrated apparatus, while still remaining within the scope of the invention. The exemplary vending apparatus is illustrated generally as element 202.

To aid those skilled in the art in implementing particular embodiments of the present invention, the following description of exemplary parts and their sources are presented. However, use of components other than those specifically listed lies well within the contemplation of the present invention.

In the apparatus, various columns 204-1, 204-2, 204-3 . . . 204-8 are illustrated. These columns are filled with articles (not shown) which are to be dispensed to a customer. The columns need not be of identical width.

Corresponding motors 206-1, 206-2, 206-3 . . . 206-8 are illustrated as being attached to a panel 208. A different motor 206-N corresponds to each column 204-N (N=column number=1, 2, 3, . . . 8 in this example).

When an article is dispensed by means of a dispensation mechanism including a motor 206, the article falls from its column 204 to strike a chute 210. The dispensation of the article is sensed at or near chute 210 by a sensor 212. The sensor 212 produces an article dispensation signal along path 214 to send to a controller board 216.

Each motor 206-N has two pathways leading to it. A first pathway is a dedicated pathway 218-N. A second pathway is a common pathway 219. The control of the article dispensation motors may be achieved through use of a corresponding plurality of, for example, relays 220.

A set of select switches 222 is illustrated connected to selection logic 226 by means of a plurality of select signal paths 224.

A coin-receiving mechanism 228 and a bill-receiving mechanism 230 are illustrated in communication with credit logic 238 along respective paths 232 and 234. Receiving mechanisms 238 and 230 report to the credit logic when a given amount of credit has been received. Credit logic 238 may issue a control signal along path 236 to enable or inhibit the introduction of further credit (coins or bills), or cause previously-entered credit to be returned to the customer. Receiving mechanisms 228 and 230 are understood to comprise mechanisms for the return of credit to the customer, indication that correct change is required, and so forth, preferably under the control of controller board 216.

A series of displays 240, such as "sold-out" indicators or "product unavailable" indicators, are under the control of display logic 242.

The controller board 216 may advantageously comprise a printed circuit board on which is mounted central controller logic 244, such as a microprocessor, and associated support logic. The controller board 216 (described in greater detail below) governs the overall functioning of the vending apparatus.

The vending motors 206 may advantageously be 7 rpm motors manufactured by Merkle-Korff Industries, 1776 Winthrop Drive, Des Plaines, Ill. 60018. However, suitable alternate implementations of the motor may be those which have characteristics equivalent to a fractional HP gear motor, 6 to 8 rpm output (110 V, 2.2. amp) such as that manufactured by ECM or BREVEL.

The sensor 212 may advantageously be an impact sensor, such as one manufactured by Versatile Control, of Novato, Calif. The sensor may operate on principles such as detection of vibration, detection of shock, detection of motion, and so forth. The sensor may comprise a photo-detector, in which the article being dispensed interrupts a light beam, which interruption is detectable and reportable to the controller board.

The controller board 216 may advantageously comprise controller boards as known in the art. For example, Versatile Control, of Novato, Calif., is a suitable controller. Such a controller uses an MC68705U35 processor, available from Motorola, Inc., of Shaumberg, Ill. Of course, use of alternative processors and implementation of the logic circuits and functions on the controller board may be made, so long as they are capable of performing the sensing, decision and control functions described in this specification.

Central controller logic 244 may be implemented using a variety of microprocessors known on the market. It may be found simpler to use a commercially available design for a controller board 216 instead of designing a controller board from scratch. MARS Money Systems, of Philadelphia, Pa., markets a controller board which has many of the basic components of a controller board needed for implementing the present invention. Software may be written as described herein, to adapt such controller boards to a desired application. Advantageously, the means by which the vending of articles from the columns is controlled is programmed into a Programmable Read Only Memory (PROM) present on the same chips as, or on a PROM chip separate from, the microprocessor. The instructions are understood to be capable of programming in a variety of computer languages, as is easily appreciated by those skilled in the art.

Similarly, although such elements as selection logic 226, credit logic 238, and display logic 242 are schematically indicated a being separate portions of the controller board 216, it is understood that various portions of the hardware may be implemented in software (that is, be functionally resident within the microprocessor). In particular, the logic blocks 226, 238, 242 may simply comprise buffer/drivers and/or buffer/receivers known in the art, or they may comprise digital circuits performing the logic functions described herein.

The relays 220, functioning as computer-controlled switches, may advantageously be equivalent to OMRON G2E-184P-M-US. These are present on the controller board available from Versatile Control. However, suitable alternate implementations of the motor switches may be those which have the characteristics equivalent to double-pole, double-throw 110 VAC, 5 A contact with 24 VAC coils, such as those manufactured by POTTER & BRUMFIELD or ESSEX, for example.

The select switches 222 may be any of those known in the art, such as Model No. V7 switches, available from MICRO SWITCH, of Freeport, Ill. However, suitable alternate implementations of the select switches may be those which have the characteristics equivalent to single-pole, single-throw miniature switches such as those manufactured by UNIMAX CORPORATION or CHERRY ELECTRIC, for example.

The coin-receiving mechanism 228 and the bill-receiving mechanism 230 may also those which are commonly employed in the art, such as Model Nos. C9301-L and CBA-2, available from COIN ACCEPTORS, INC., of St. Louis, Mo.

Figure 3:
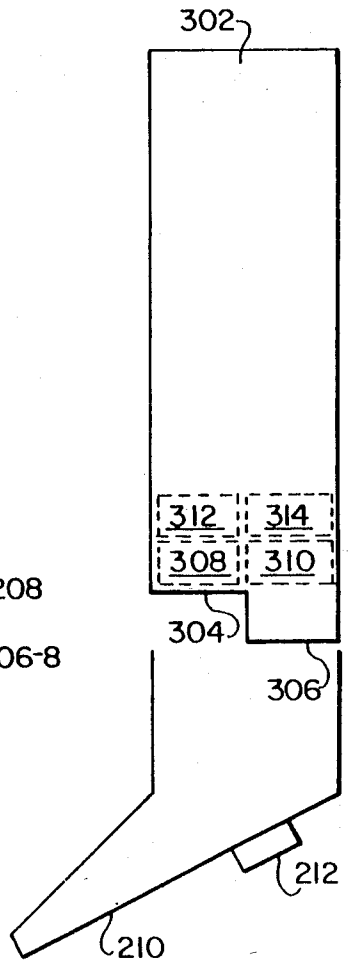
FIG. 3 is a side view of a certain portion of the apparatus shown in FIG. 2.

FIG. 3 illustrates a side view of certain elements shown in FIG. 2. Specifically, the chute 210 is illustrated with the sensor 212. Sensor 212 is, in this particular illustrated embodiment, an impact sensor available from Versatile Control. FIG. 3 also illustrates a side panel 302 having, on its bottom side, a higher edge 304 and a lower edge 306. Articles for dispensation, such as cans of soda, are illustrated as elements 308, 310, 312 and 314. When a product is selected for dispensation, a product such as 308 falls from the column defined by separator panels 302 onto the chute 210 to be detected by a sensor such as the impact sensor 212.

Figure 4:
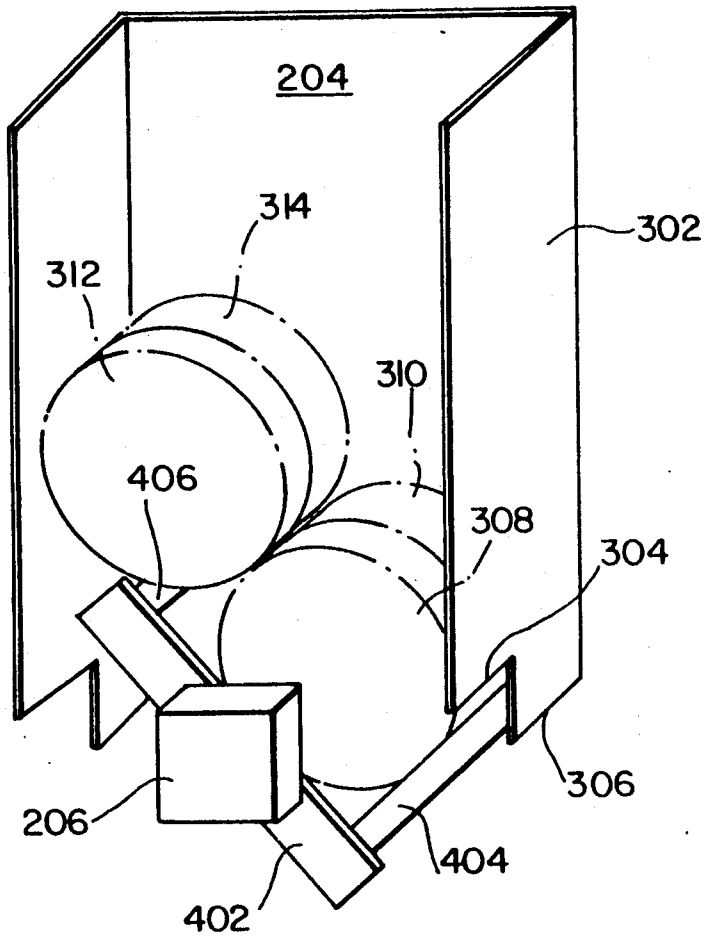
FIG. 4 is a perspective view of a dispensation mechanism, with several elements omitted for graphic clarity, for illustrating certain dispensation features which may be used in conjunction with the present invention.

FIG. 4 illustrates certain details of a vending mechanism which may be used in conjunction with embodiments of the present invention. As described above, FIG. 4 illustrates various elements which may be used in conjunction with the present invention. Many of the elements, such as a column 204, an arm 402 attached to first and second rods 404 and 406 about an axis coincidental with center rod 408, rotatable by a motor 206 (possibly through a crank mechanism), are known in the art. However, it is the absence of certain elements in FIG. 4 (such as cams, and unnecessary switching and wiring arrangements) which illustrate some of the advantages of the present invention. The timing and control of the activation of motor 206, for example, distinguish the present invention over known systems. The presence of certain common elements in the vending apparatus does not render obvious the combination of all elements recited in the claims.

An advantage of the present invention, in reducing the selection-dispensation delay time to below a certain threshold or to within a certain delay range, or to an optimum delay, is described in greater detail below, with respect to FIG. 5. Briefly, however, the present invention operates on the principle that the vending mechanism motor should run for a strategically selected length of time so that the dispensation mechanism is poised for a quick delivery of a subsequently selected item.

Figure 5:
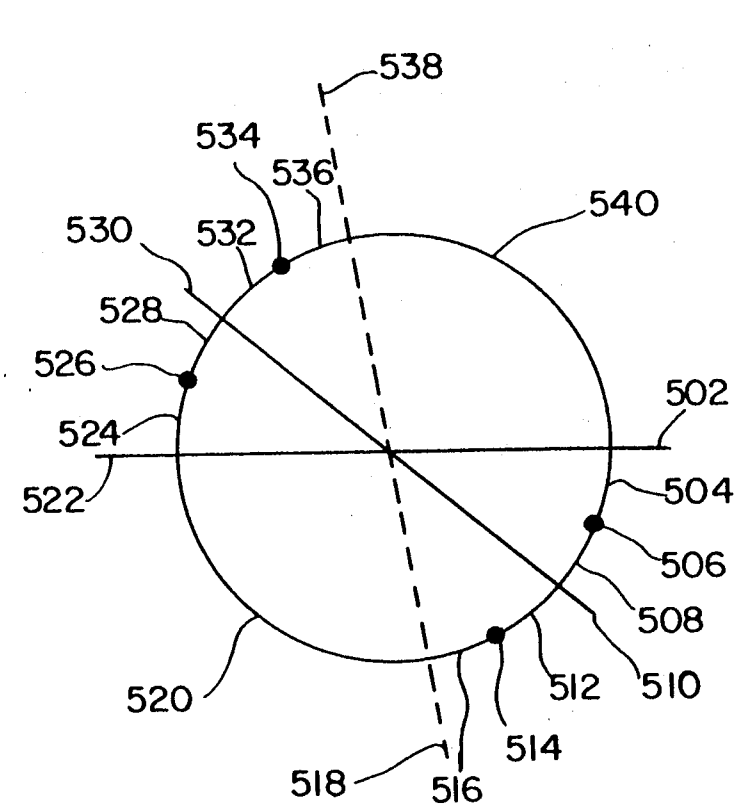
FIG. 5 is a diagram illustrating the advantage of the present invention in anticipating the proper amount of time to run the dispensation mechanism after a first article is dispensed, to reduce the time delay before a subsequent article is dispensed.

FIG. 5 is a diagram illustrating schematically the angular position of the arm 402 (FIG. 4) as it is rotated by the motor 206 in dispensing articles. FIG. 5 is very schematic in nature, and is representative of a simple example showing operation of a vending mechanism, such as that in FIG. 4. However, the present invention may be applied to vending apparatus different than that shown in FIG. 4, and timing schemes may be employed different than that shown in FIG. 5. For example, a column 204 may be more than two articles deep. In such an instance, the particular diagram in FIG. 5 is no longer applicable. However given the description accompanying the flow chart shown in FIG. 6, those skilled in the art are readily able to adapt the present invention for use in vending apparatus having different depths of articles, different timing cycles, and so forth.

A line in FIG. 5 which is illustrated as being horizontal (or vertical) should not be interpreted as representing a purely horizontal (or vertical) orientation of arm 402. Indeed, in a double-wide column such as 204-1, 204-2 or 204-3, the dispensation mechanism need not even rotate unidirectionally throughout a full 360° arc; rather, the motor may cause the arm (via a crank mechanism) to "oscillate" between a first angle (for example, −45°) and a second angle (for example, +45°) to achieve the dispensation goal. In contrast, single width columns such as 204-4 and 204-5 may have arms which do rotate unidirectionally throughout a 360° arc, causing dispensations at predetermined points along the way. With this in mind, FIG. 5 is not necessarily a diagram of the physical angle of an arm in a dispensation mechanism. Rather, FIG. 5 illustrates schematically the relative angular locations of the arm at the times of occurrence of various events for purposes of illustrating the concepts of the present invention. Presuming an essentially constant rotational velocity, the angles in FIG. 5 illustrate, by implication, the amount of time a motor should run to move the arm by the corresponding angle, including any directional reversals not explicitly shown.

Initially, arm 402 is assumed to be in a position 502. As the motor 206 corresponding to a corresponding column 204 (FIGS. 2 and 4) is activated, the arm changes its orientation, traversing path 504. At point 506, an article is dispensed. The motor continues to run for a time period (determined as described below with respect to FIGS. 6, 6A or 6B), so that the arm traverses an angle 508. The motor stops when the arm is at angle 510. The arm rests at an angle 510 until the motor is activated again.

In the next vend cycle, the motor is activated again. In a similar manner to that described above, with respect to path 504, the arm now traverses an angular path indicated at 512. At an angle 514, a second item is dispensed. During this vend cycle, in contrast to the vend cycle in which angles 504 and 508 were traversed, the motor stays on for a longer period of time. Because the motor stays on for a longer period of time (not stopping at angle 518), the arm traverses a greater angle, as indicated at 516 and 520. Finally, the motor stops and the arm is left at an angle 522, poised for a subsequent dispensation at 526.

FIG. 5 illustrates further vend cycles which, in this simple but commonly employed example, are similar to the vend cycles described above. Specifically, paths 524 and 528 correspond to paths 504 and 508, respectively. Similarly, an object is dispensed at 526 (corresponding to 506), and the arm comes to rest at an angle 530 (corresponding to 510). Paths 532, 536 and 540 correspond to paths 512, 516 and 520, and angles 538 and 502 correspond to angles 518 and 522.

From the above description of FIG. 5, it is seen that a longer period of activation of the vending motor causes the arm to pass through angles 518 and 532 without stopping. The fact that the arm progresses to angles 522 and 502 shortens the length of time which must be experienced at the beginning of a subsequent vend cycle. The length of time which must be experienced at the beginning of a vend cycle corresponds to the time delay between the time a user indicates his selection, and the time his selected article is dispensed. Minimization of this time delay is a primary object of the present invention. As can be clearly seen from the diagram in FIG. 5, this selection-dispensation time delay is illustrated as corresponding to angle paths 504, 512, 524 and 532. In the absence of an extension of path 516 by 520 (and an extension of 536 by 540), selection-dispensation delays 504 and 524 would be unnecessarily long. Paths 504, 512, 524 and 532 are kept optimally short.

The present invention provides for an anticipation of the amount of time it will take to subsequently dispense an item in response to a customers selection. Several methods in which this advantage may be achieved are next described, with special reference to FIGS. 6 6A and 6B.

Figure 6:
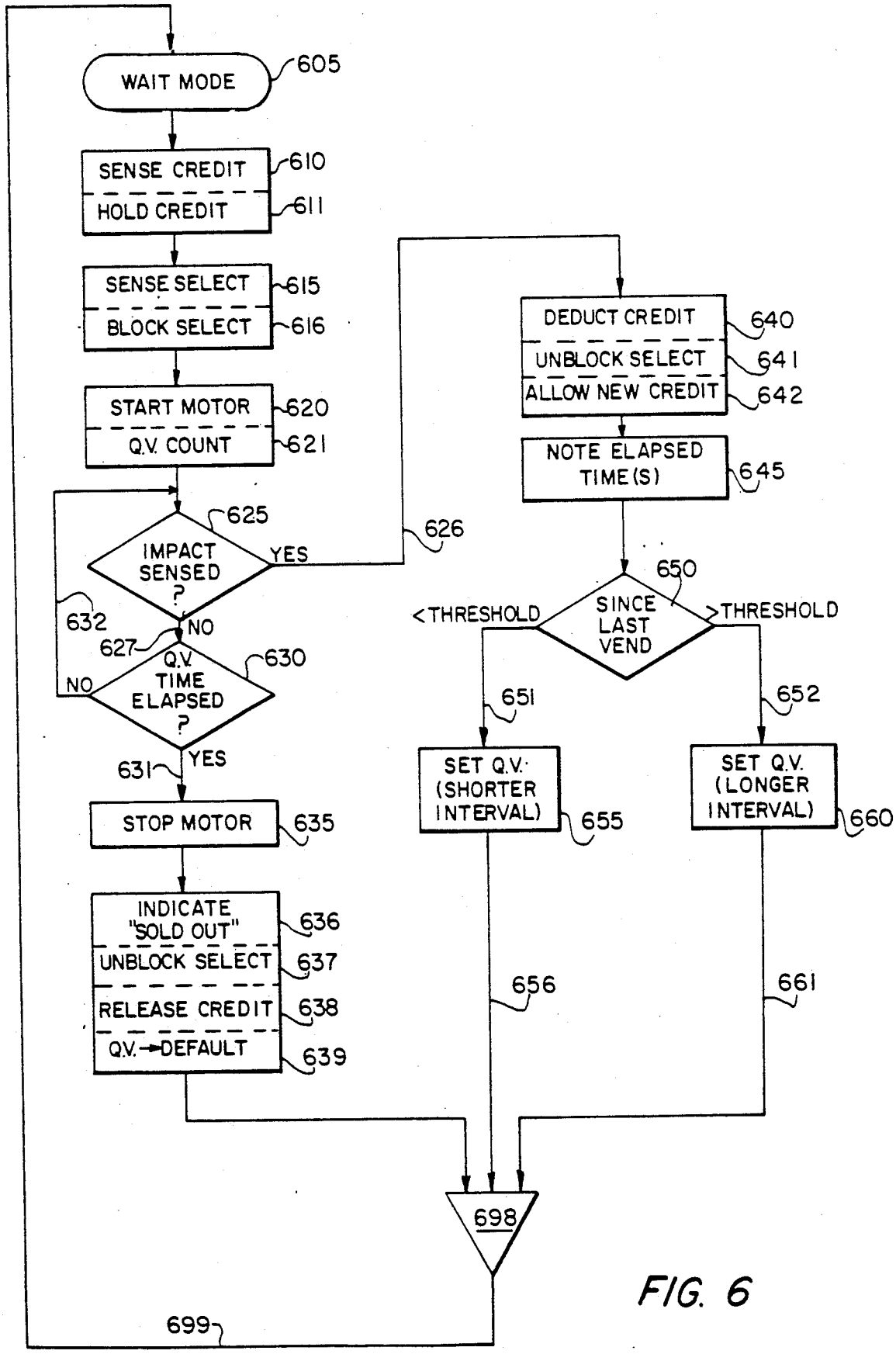
FIG. 6 is a flow chart illustrating a first method of operating the embodiment shown in FIG. 2.

FIG. 6 is a flow chart illustrating the steps which controller 216 (FIG. 2) executes in software or "firmware," in a preferred embodiment. FIG. 6 illustrates those steps which facilitate the understanding of the present invention. Many features other than the "memory and learning" feature illustrated in FIG. 6 may be added, and still remain within the scope of the present invention. For example, the verification that the amount of credit entered by a customer meets or exceeds the item price is a consideration known to those skilled in the art, and need not be explicitly illustrated in FIG. 6.

Referring specifically to FIG. 6, the vending apparatus according to the present invention is most often in a wait mode 605. In the wait mode, the apparatus is waiting for an input of some sort, normally expected from the coin- or bill-receiving mechanisms 228 and 230 (FIG. 2).

When a customer inserts a coin or bill, receiving mechanisms 228 or 230 report their credit along respective paths 232 and 234 to the controller board 216. At this point, credit is said to be "sensed" by the controller board, at 610. At 611, credit is said to be "held" (recognized), for the steps which follow.

After the credit is sensed and held, a customer select, received along one of paths 224 from select switches 222 is sensed, at 615. Given a sensed customer select, the processor causes other customer select signals to be blocked, at 616. Advantageously, the block select function 616 may be implemented in hardware, in selection logic 226 (FIG. 2). Specifically, each of the select paths is input to the first input of respective AND gates. The second input of the AND gates is a blocking signal which is lowered to the inactive state, thereby preventing further select signals from reaching the output of the gate. Advantageously, a microprocessor may receive the initial select signal, generate the blocking signal, and then carry on further operations without being interrupted by further select signals. Of course, variations on this interrupt prevention circuit may be practiced in accordance with the present invention.

At block 620, the controller starts the motor 206 which corresponds to the column of products selected by the user. Concurrently, the controller causes the start of a timing countdown of a "quick-vend" (QV) variable. Briefly, in this embodiment, the QV variable determines how long the motor shall run before being turned off. The initial value of the QV variable is described in greater detail below, with respect to blocks 655 and 660 (for after a sensed dispensation), but may be set to a default value in the event no dispensation is sensed.

After the motor is started, the processor enters a loop. The loop is defined by decision blocks 625 and 630 and intervening pathways 627 and 632. At block 625, the sensor 212 is either interrogated (or, in the event an interrupt scheme is chosen, passively ignored). The arm 402 (FIG. 4) is now traversing an angle 504 (FIG. 5). Because, at first, no impact should be sensed, control passes along pathway 627 to decision block 630. The controller checks to see whether the time (initially defined by the value of the QV variable) has elapsed. Since, at first, the time will not have elapsed, control generally passes on path 632 back up to decision block 625 to determine whether an impact has yet been sensed.

Assuming that not all of the articles in a given column are sold out, and that there has been no mechanical malfunction, eventually, an article will fall from the column 204 to strike the chute 210 (FIGS. 2 and 3). At this point, the logic loop 625, 627, 630 and 632 (FIG. 6) is exited along path 626. At this point, an impact has been sensed, so that arm 402 is at an angle 506 (FIG. 5).

Immediately after the impact is sensed, various "bookkeeping" functions may be performed. For example, return of credit may be blocked, as indicated at block 640. Any "change" (credit in excess of item cost) may be ordered by the controller along path 236 to mechanisms 228 and 230. Also, as indicated at block 641, the select function of the customer is unblocked, allowing selection of an item for a subsequent vend cycle. New credit may also be enabled (642) so that a customer need not even wait until the motor stops running before inserting more money for a subsequent selection.

The controller notes, at 645, a "history" of the amount of time which has elapsed between one or more of the most recent dispensations of an article from that particular column. In the present case, the processor will look to the time when previous dispensations (at sometime in the recent past) were detected. As will be appreciated upon an inspection of FIG. 5, the controller will note the time which has elapsed when the motor was on and running for a given column (generally, a fraction of a second or a few seconds), and not the "real time" when the last article was dispensed (which could be hours or days in the past). Block 645 may involve the analysis of more than one elapsed time, in situations more complex than that illustrated in FIG. 5; the functions performed at block 645 in more complex situations are further explained below.

From block 645, control passes to a decision block 650. The motor-running time which has elapsed since the last dispensation (presumably, in FIG. 5, the motor-running time between vend 534 and vend 506) is compared to a threshold. If the time elapsed is less than the threshold, control passes along path 651 to block 655. If the elapsed motor-running time since the last sensed dispensation is greater than or equal to the threshold value, then control passes along path 652 to block 660.

The threshold is set in the following manner. Referring to FIG. 5, the threshold should be set at some point between a short vend time (508 plus 512), and a long vend time (536 plus 540 plus 504). In this manner, the decision block 650 will determine in a subsequent dispensation cycle whether the most recent vend was a "quick-vend" or whether it was not a "quick-vend."

In a particular example where the arm is assumed to be in position 506 (FIG. 5), the time elapsed since the last dispensation corresponds to paths 536 plus 540 plus 504, which is greater than the threshold described immediately above, so that control, in this case, will pass along path 652 to block 660. At block 660, the QV variable will be set to a longer time period, such as 512 plus 516 plus 520. This will determine, in subsequent executions of block 621, the value of the QV variable for running the motor.

Conversely, if the present cycle were a quick-vend (such as if dispensation 514 had just been sensed), then control would have passed from decision block 650 to block 655. At block 655, a shorter value of the QV variable (such as the time corresponding to 524 plus 528) would be set.

It is understood that, in certain embodiments, the motor will continue running past the time when an impact is sensed at decision block 625. The detected quick-vend at decision block 650 and the setting of the QV variable at either block 655 or 660 occurs in a very short period of time following the sensing of the impact. Provision should be made for temporary storage of the new QV variable so that, when the motor does finally stop running, the new value of the QV variable is inserted into a proper memory location in anticipation of its being used in block 621 in a next iteration.

Actual QV time delays may be compared to delays from either dispensation-sensing to dispensation-sensing (e.g., 506 to 514) or from stop position to stop position (e.g., 502 to 510), as long as a consistent scheme is followed.

Regardless of which block, 655 or 660, causes the assignment of a value to the QV variable, control passes either along paths 656 or 661 to the wait mode block 605. (Block 698 and path 699 have no logical significance, but reduce the quantity of lines present on the flow chart.)

It is appreciated by those skilled in the art that the decision block 650, and the two blocks 655 and 660 function as a "flip-flop." That is, in a timing arrangement such as that shown in FIG. 5, the amount of time which a motor should run to reduce the selection-dispensation delay of a subsequent dispensation cycle, simply alternates between a short post-detection time and a long post-detection time.

However, if the physical configuration of the column is different than that shown in FIG. 4 (and the timing, therefore, is different than that of FIG. 5), then the flow chart from blocks 645 through 660 is more complex. The logic involved in determining the next subsequent post-dispensation-sensing motor run must be determined through analysis of a longer history of the times elapsed between prior impact sensings. For example, in a vending machine in which the columns are three articles deep, at least the two time periods between the three most recently sensed dispensations would have to be noted at block 645. Then, decision block 650 would have to be not a two-way decision block, but a three-way decision block. The choice of which of the three pathways on which to pass control would be made in accordance with an analysis of the recent history of the sensed impacts. A third "set QV variable" block would be added to the specifically illustrated blocks 655 and 660. The variable would, in general, be designed to cause the motor to run in a manner to reduce the selection-dispensation time experienced in the next subsequent vend cycle.

The logic described may be extended to even more complex vending mechanisms than FIG. 4, with correspondingly more complex vending cycle timing than shown in FIG. 5. Using the above principles, a vending apparatus of arbitrary complexity may be designed by those skilled in the art.

It will also be appreciated by those skilled in the art that the anticipation of how long the motor should run during a particular dispensation cycle need not be determined with respect to the entire ru time of the motor (e.g., 502 to 510; 510 to 522). It may be determined in accordance with the time of a present dispensation. This second implementation involves the setting of the presently-executing QV variable (e.g., 506 to 510; 514 to 522), rather than allowing it to merely affect the subsequently starting of the motor at blocks 620 and 621. In this latter implementation, the system may be made responsive to a more recent "history" of dispensations, in that the present sensed dispensation may be made to control how long the motor runs in the current dispensation cycle.

Figure 6A:
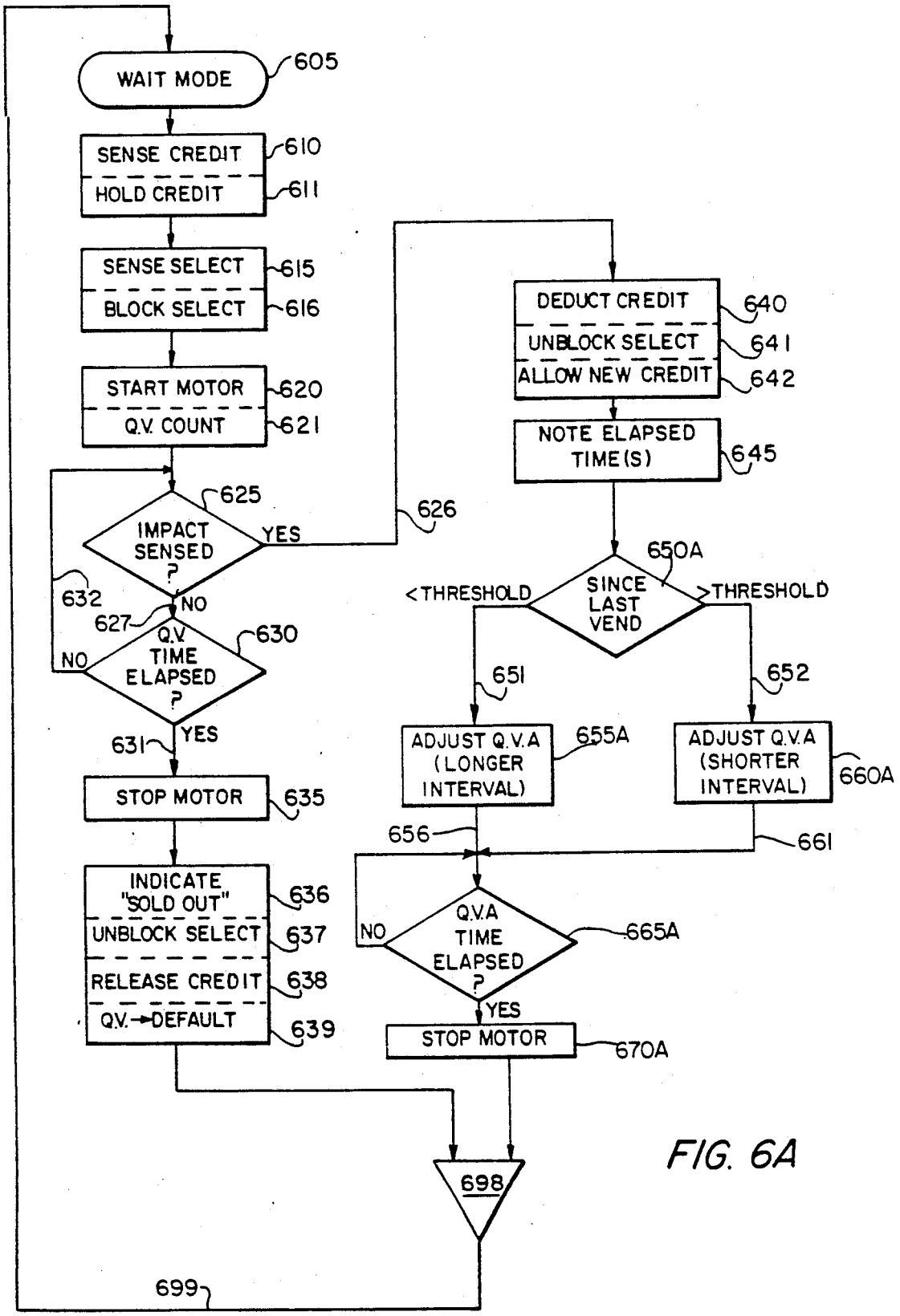
FIG. 6A is a flow chart illustrating a second method of operating the embodiment shown in FIG. 2.

FIG. 6A illustrates this strategy of dynamically adjusting the length of the running of the motor in the present dispensation cycle based on the present sensed dispensation. Blocks 645, 650, 655 and 660 (from FIG. 6) have been replaced with respective blocks 645A, 650A, 655A and 660A. In the embodiment shown in FIG. 6A, block 645A indicates the notation of the present dispensation time, in addition to the time of dispensation of articles in the recent past. Block 650A denotes the comparison of this elapsed time (or, more generally, recent timing history) to a threshold (or set of thresholds applied to the history). Blocks 655A and 660A denote the adjustment of the present variable in accordance with the recent timing history. The setting of QVA as longer, and shorter, intervals is reversed from that of FIG. 6 because the presently sensed dispensation is included in the dispensation history, thus causing the opposite state of the "flip-flop" action to be appropriate.

Blocks 665A and 670A denote the continuous testing of the elapsing of time set by the value of the QVA variable, and stopping the motor at the end of that time. In this embodiment, the setting of the QV variable at block 621A is set according to default value(s), for use in the timeout loop governed by decision block 630. In FIG. 6A, the QV variable comes into play in the event of a sold out condition or faulty dispensation, and may itself vary with whether or not a "fast vend" was recently experienced.

Figure 6B:
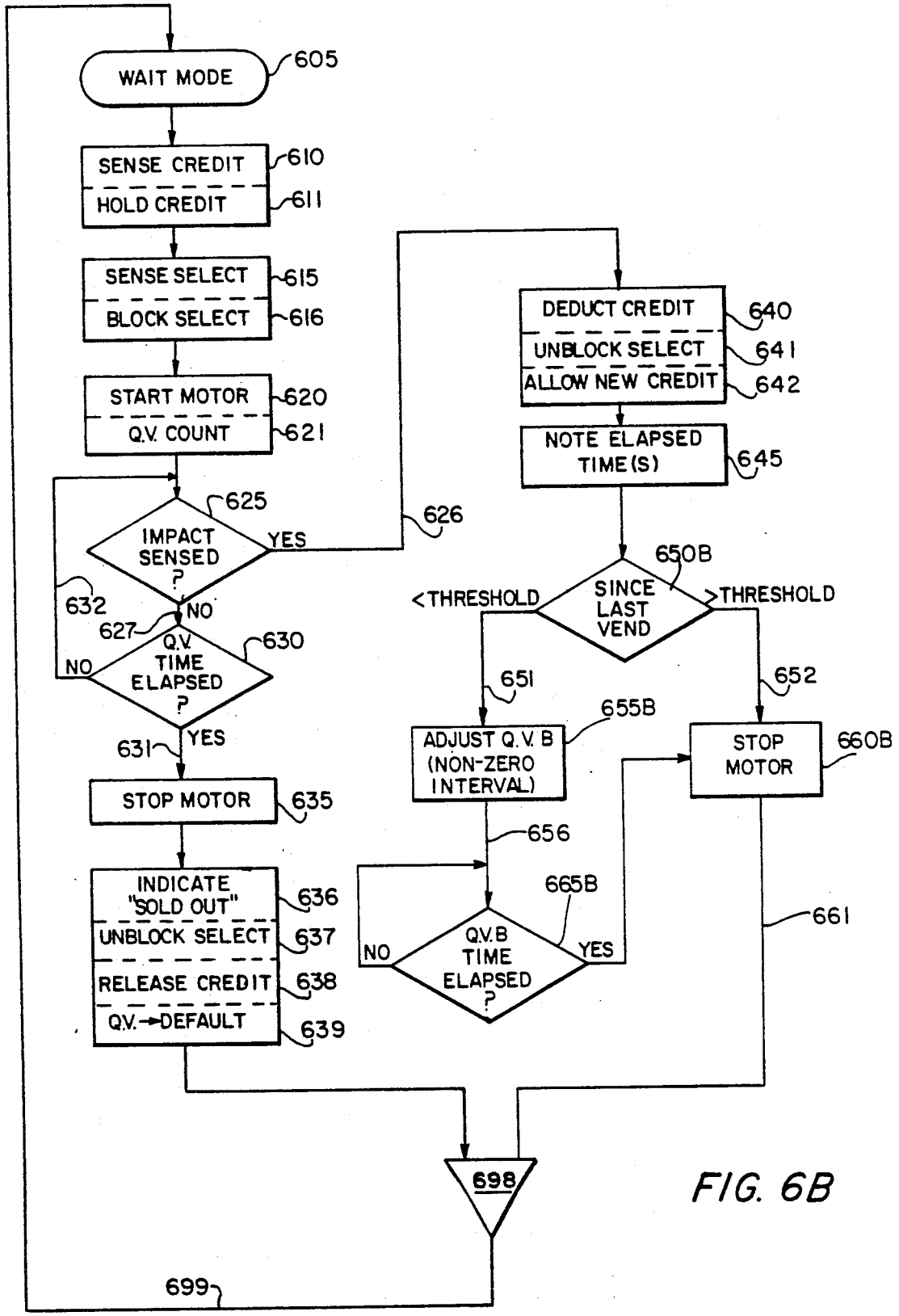
FIG. 6B is a flow chart illustrating a third method of operating the embodiment shown in FIG. 2.

FIG. 6B is a flow chart illustrating another method of dispensation control which may have characteristics in common with either of the methods in FIG. 6 and 6A, but is illustrated as if more particularly resembling FIG. 6A (with its dynamic adjustment of the duration of present motor running time). In FIG. 6B, blocks 655B and 660B are of special interest. In one sense, FIG. 6B can be thought of as a special case of FIG. 6A, in which the "shorter interval" which was set in block 660A is set to zero. That is, when the time elapsed (or recent history) indicates that the next subsequent dispensation will occur without additional running after the present sensed dispensation, then control passes to block 660B, where the motor is immediately shut off. In accordance with FIG. 6A, block 655B sets a longer period for continuing to run the motor if block 650B determines that the a quick vend was experienced in the recent past, so that the motor should run a longer period of time in the present, so as to poise the dispensation mechanism for an optimum subsequent dispensation in the future.

Returning to discussion of FIG. 6 and specifically decision block 630, it will now be assumed that the time designated for running of the motor has elapsed, generally indicating a "sold out" condition. In this case, control passes along path 631 to block 635. The controller issues a signal to the activated relay (among the relays 220) corresponding to the motor which has been running. This signal causes the motor to stop.

Subsequently, various "bookkeeping" tasks are handled. Specifically, the tasks may include the visible indication of a "sold-out" function, viewable (and also possibly audible) by the customer, at 636. Also, 637, the customer select function is unblocked, enabling another selection in a future vend cycle. At 638, the proper handling of the credit held in block 611 is accomplished, causing either a release of the credit (returning the money to the customer) or the retaining of the credit for an immediately following selection, as warranted. Finally, the QV variable is set to a default value (as it was before first entering the wait mode 605), so that on the next dispensation cycle after the column is reloaded with articles, the apparatus will dispense a single article properly. The particular value of the default value of the QV variable varies with the particular implementation, and is definable in accordance with principles known to those skilled in the art upon analysis of the particular dispensation mechanism.

The feature of certain embodiments of the invention that the system intelligently "anticipates" a subsequent dispensation cycle, running the motor for a period of time needed to minimize the selection-dispensation delay in the subsequent cycle, advantageously ensures reliably fast dispensation. Also, the fact that entry of new credit is allowed immediately after an impact is sensed, decreases any time delays experienced by the customer, even during the period when the motor is running to poise itself for a subsequent selection.

Determination of whether a product has been dispensed by sensing of the impact of a product on a chute, or the expiration of a certain time period, is advantageous. Specifically, it is more advantageous than known schemes in which the dispensation mechanism is turned to a given point, regardless of whether a dispensation has properly occurred. Many known systems cannot ascertain whether there has been a "dry vend" (no impact sensed within a short period of time) or whether there is a "sold-out" condition (no impact sensed within a longer time period). According to the present invention, the time which has occurred since the last dispensation is analyzed according to one or more time thresholds. The fact that an impact of an article on the chute is sensed later than expected, but before warranting a conclusion that the articles are sold-out, is interpreted as a "dry vend," so that the QV variable for a next subsequent vend is adjusted accordingly. In this manner, the loss of customer satisfaction experienced when encountering a "dry vend" is avoided.

The fact that a successful dispensation is measured reliably, such as impact on a chute or through photoelectric means, allows different-sized objects to be placed in the same column without modifying the dispensation mechanism for that column. For example, if a larger article were placed in a column which is normally occupied by articles two deep, the larger articles will be dispensed at only one-half of the rate of the smaller original articles. However, because the slower rate of dispensation is interpreted as a "dry vend" followed by a successful vend, the mechanism is caused to continue the vend cycle until the larger article is finally dispensed. The dispensation ensure not only flexibility in stocking the vending apparatus, but promotes customer satisfaction.

Especially in the case of an electronic controller, the ability to select and vary the price of different selections is facilitated.

Although sold-out paddles may be employed in conjunction with the present invention, they are no longer necessary. A "sold-out" condition may be sensed through the expiration of a time period after a selection in which no impact of an article is sensed on a chute.

The concentration of intelligence in the apparatus allows off-the-shelf "dumb" coin mechanisms to be used, with resultant cost savings. Among the functions and elements which no longer need be incorporated in the coin mechanism are price setting and pay-out switches.

The use of functionally sophisticated, but physically simple, components reduces the number of switches and the amount of wiring, so that reliability is increased, thereby reducing the cost of both service calls and the chance of faulty assembly during the manufacturing phase.

Figure 7:
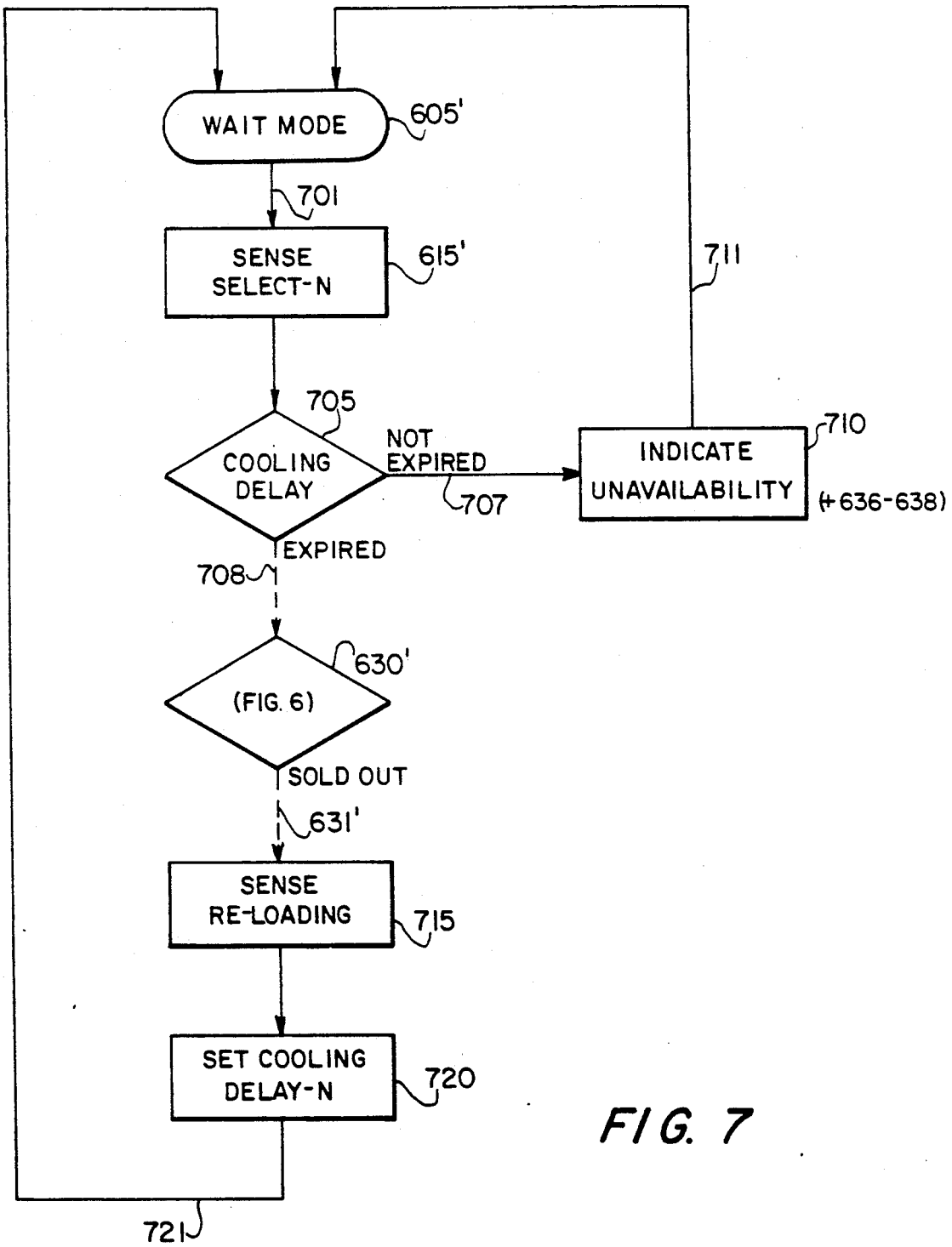
FIG. 7 is a flow chart illustrating the features in which articles are brought to a proper temperature before vending, even after a "sold-out" condition is corrected.

FIG. 7 illustrates the ability of the present invention to ensure that articles (such as soda cans) are of the proper temperature after a "sold-out" condition has been corrected.

The embodiment in FIG. 7 operates on the principle that the vending apparatus should not distribute an article after it has been loaded until a predetermined time has expired after the loading. Waiting this predetermined time ensures that the refrigeration (or heating) apparatus brings the temperature of the articles to a commercially allowable range before the articles are allowed to be vended.

Referring again to FIG. 7, the ability of the present invention to provide articles of proper temperature, even after a "sold-out" condition is corrected, is illustrated in a preferred embodiment. FIG. 7 is understood to be operated in conjunction with FIG. 6. The figures have been separated so as to independently illustrate the various features and advantages of the present invention.

The wait mode 605' is entered (in the same manner as FIG. 6). Path 701 indicates (with omission of certain blocks from FIG. 6) the passage of control to block 615', when a selection of an article from the n'th column by the customer is sensed. Decision block 705 determines whether a predetermined delay, here called a "cooling delay," has expired. Briefly, the delay which is here examined is the delay which occurs after the column has been reloaded with articles after a "sold-out" condition. The duration of the cooling delay is determined in accordance with principles described below, with respect to block 720.

If the cooling delay period has not expired, control passes along path 707 to block 710. In block 710, the unavailability of articles in the selected column is indicated to the user. Also such "bookkeeping" tasks as were described above, in blocks 636, 637 and 638, may also be performed. Control then flows back along path 711 to the wait mode 605'. This loop embodies the refusal of the apparatus to dispense articles which are not of the proper temperature.

If, in contrast, the cooling delay has expired, control passes along path 708 to execute the blocks indicated in FIG. 6 which follow block 615. Until a sold-out condition is encountered, items are dispensed in the normal manner shown in FIG. 6. When a sold-out condition is again encountered (indicated as passage of control along path 631'), then control passes to block 715.

Block 715 represents the sensing of the reloading of articles into the column which had been previously detected as being sold-out. Advantageously, the sensing of a reloading of articles into the sold-out column may be implemented by a continuity sensor 246 (FIG. 2) attached to the loading door of the vending machine. An opening of the door may be presumed to constitute a reloading of articles into the columns, including any columns which had been sold-out. Alternative methods of determining or implying reloading, such as switches triggered by the presence of an article at the bottom of a column, also lie within the contemplation of the present invention.

When the door is re-closed, or the reloading process sensed in some other way, control then passes to block 720. At block 720, the "cooling delay" for the n'th column is set. The length of the cooling delay should be determined in accordance with principles known to those skilled in the art. For example, in the case of soda cans, the length of time should be set to be equal to the time it takes for the given refrigeration mechanism to cool the cans down into a commercially acceptable temperature range.

After the cooling delay has been set, control passes along path 721 up to the wait mode 605'. The timing mechanism for the cooling delay may be implemented using real-time clocks, or other timing mechanisms known in the art. Any timer which may be set to a desired time delay, and which can be examined at decision block 705 to determine whether the time delay has expired, is envisioned by the present invention.

Although the particular examples shown in FIG. 7 has been described with special reference to the cooling of soda cans, it is understood that the principles embodied in this example may be extended to other articles than soda cans and other processes than cooling. For example, the warming of soups or other food stuffs exemplifies applications of the present invention in delaying dispensation until a given attribute of the articles (e.g., temperature) is acceptable.

The present invention therefore allows the customer the guarantee that the articles which are dispensed will be of the desired temperature, even after a "sold-out" condition has been met. Also, the vendor is allowed the ability to sell all products in a column, without having to sacrifice two or more articles at the end of a loading cycle.

Figure 8:
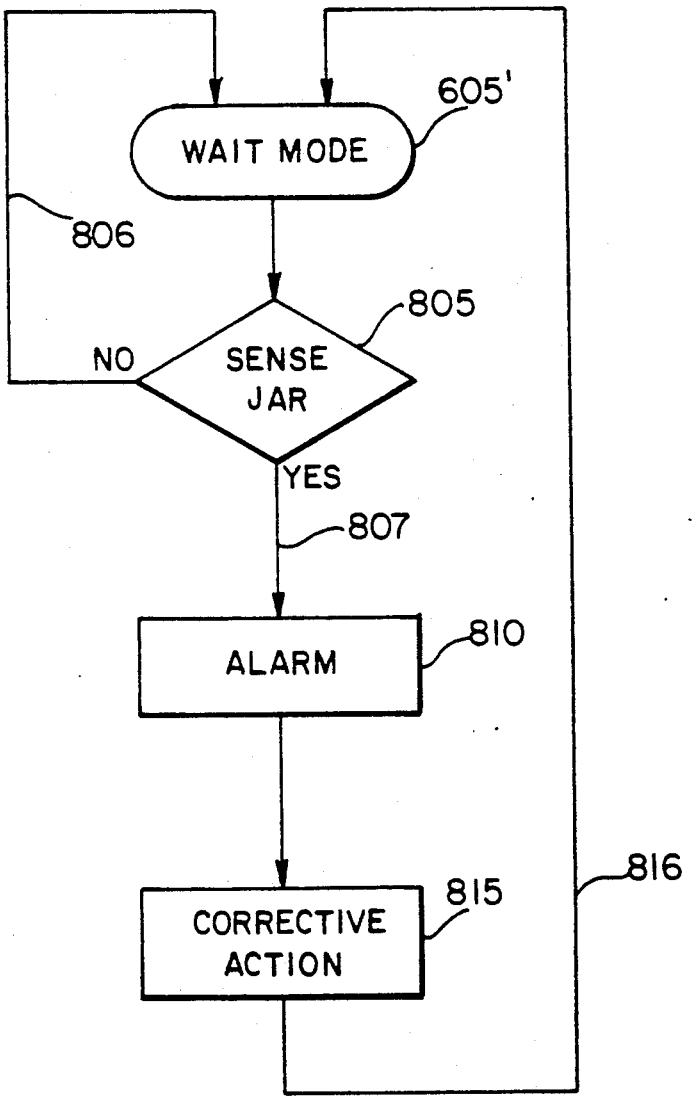
FIG. 8 is a flow chart illustrating the system in which an alarm sounds if the vending apparatus is tipped to attempt improper removal of articles.

FIG. 8 illustrates in flow chart form a system and method by which the present invention may respond to improper jarring of a vending apparatus by a customer. It is known that certain vending machines have the defect that a forward-to-backward rocking motion may allow an item to be released from a column improperly (one example of this potential danger is shown in the apparatus of FIG. 4, in which, after article 308 has been dispensed, a forward rocking motion of the motion may cause article 310 to fall forward, and be dispensed under higher edge 304). This manner of dispensation not only constitutes theft, but causes a "dry-vend" in which the next subsequent customer in many known systems receives no product, resulting in a loss of good will toward the vending apparatus manufacturer, and perhaps also to the article manufacturer.

The present invention envisions the following solutions to the above-described theft problem.

Referring to FIG. 8, the wait mode 605' is entered. Beneath the wait mode 605', a decision block 805 is entered. As is the case in many loops described in the present specification, the loop illustrated as 605', 805 and 806 may be implemented using any of a variety of techniques known in the computer arts, such as repetitive polling of a register containing information derived from a sensor, and/or an interrupt scheme in which the sensing of a certain event causes an interrupt to a circuit such as a microprocessor.

At decision block 805, a sensing of a "jar" (including tipping or a forward-to-backward rocking motion) is indicated. The sensing mechanism or orientation switch 248 (FIG. 2) may comprise a mercury switch, such as those which are known in the art. If a jar is not sensed (a normal condition), then control passes along path 806 to return to the wait mode. However, if a jar is sensed, control passes along path 807 to block 810.

At block 810, some warning action is taken. Either an audible alarm (such as those commonly used in smoke detectors), or a silent alarm to a remote location where supervisory or alarm enforcement personnel may be informed, or both, may be sounded. The sounding of an audible alarm at the vending apparatus location deters further attempts by the "customer" to improperly acquire articles from the apparatus. Both the local and remote alarm systems aid in the apprehension of such "customers."

Also, after a jar is sensed, other corrective action may be taken, as indicated generally at block 815. Such corrective action may include the locking of mechanisms in the apparatus for a given time to prevent further operation of (and potential damage to) the vending apparatus. Also, such techniques such as photographing the "customer" who is shaking the machine, may also be implemented.

After any corrective action is taken at block 815, control passes along path 816 back up to the wait mode 605'. In this manner, an alarm may be sounded, and any corrective action may be taken, for any given time period after the jarring is sensed. Thereafter, the apparatus may return to its normal mode of operation, so that bona fide customers may again purchase articles.

From the above, it is apparent that many modifications and variations of the present invention are possible in light of the above teachings. It is therefore to be understood that, within the scope of the appended claims, the invention may be practiced otherwise than as specifically described.

What is claimed is:

1. A vending apparatus, comprising:

an article selection device for receiving a customer selection, and generating an article selection signal;

means for storing one or more articles to be dispensed;

a dispensation mechanism for dispensing the articles from the means for storing;

a sensor for sensing when an article has been dispensed, the sensor generating an article dispensation signal; and a dispensation controller for controlling the dispensation of articles by the dispensation mechanism, the dispensation controller comprising:

a) means for activating the dispensation mechanism in response to the article selection signal;

b) means, responsive to the article dispensation signal from the sensor, for effectively measuring the times of occurrence of one or more recent dispensations; and c) means for deactivatign the dispensation mechanism in accordance with the measured times of the one or more sensed dispensations, so as to reduce a time delay between a subsequent article selection and the dispensation of that article.

2. The apparatus of claim 1, wherein the sensor includes a shock sensor which is attached to a chute disposed beneath the dispensation mechanism, which generates the article dispensation signal when the dispensed article strikes the chute.

3. The apparatus of claim 1, wherein the sensor includes an optical sensor which is disposed near a chute beneath the dispensation mechanism, which generates the article dispensation signal when the dispensed article rolls down the chute.

4. The apparatus of claim 1, wherein the dispensation controller includes a microprocessor-driven circuit board whose microprocessor executes instructions so as to cause activation and deactivation of the dispensation mechanism, the microprocessor being part of the dispensation controller which measures the times of occurrence of the one or more recent dispensations.

5. A vending apparatus, comprising:

an article selection device for receiving a customer selection, and generating an article selection signal;

columns for storing a plurality of articles to be dispensed;

a dispensation mechanism for dispensing the articles from the columns for storing, the dispensation mechanism including a rotating structure and a motor operably connected to the rotating structure for rotating the rotating structure to allow articles to fall in a controlled manner from the columns;

a chute, disposed beneath the dispensation mechanism, for contacting articles after falling from the columns, and guiding them to the exterior of the vending apparatus;

a sensor, associated with the chute, for sensing when an article has fallen from the sensor and generating an article dispensation signal; and an electronic dispensation controller for controlling the dispensation of articles by the dispensation mechanism, the dispensation controller comprising a microprocessor-driven controller board, the microprocessor executing software or firmware instructions, the software or firmware including:

a) instructions for activating the dispensation mechanism in response to the article selection signal;

b) instructions, executed in response to the article dispensation signal from the sensor, for measuring the relative times of occurrence of one or more recent dispensations; and c) instructions for deactivating the dispensation mechanism in accordance with the measured times of the one or more sensed dispensations, so as to reduce a time delay between a subsequent article selection and the dispensation of that subsequent article.

6. An automated method of vending articles to a customer, comprising:

receiving an article selection, and generating an article selection signal in response thereto;

activating a dispensation mechanism in response to the article selection signal to dispense a selected article;

sensing the dispensation of the selected article, and generating an article dispensation signal in response to the sensing;

measuring the times of occurrence of one or more recent sensings of the article dispensation signal; and deactivating the dispensation mechanism after a period of time, in accordance with the measured times of occurrence of the one or more recent sensings, so as to reduce a time delay between a subsequent article selection and the dispensation of that subsequent article.

* * * * *